US005384575A

United States Patent [19]

Wu

[11] Patent Number: 5,384,575

[45] Date of Patent: Jan. 24, 1995

[54] BANDPASS FREQUENCY SELECTIVE SURFACE

[75] Inventor: Te-Kao Wu, Rancho Palos Verdes, Calif.

[73] Assignee: Hughes Aircraft Company, Los Angeles, Calif.

[21] Appl. No.: 249,039

[22] Filed: Sep. 26, 1988

[51] Int. Cl.[6] ..... H01Q 15/02

[52] U.S. Cl. ..... 343/909; 343/911 R; 343/753

[58] Field of Search ..... 343/909, 911 R, 753

[56] References Cited

U.S. PATENT DOCUMENTS

| | | | |
|---|---|---|---|
| 3,148,370 | 9/1964 | Bowman | 343/909 X |
| 3,864,690 | 2/1975 | Pierrot | 343/909 X |
| 4,656,487 | 4/1987 | Sureau et al. | 343/909 |
| 4,785,310 | 11/1988 | Rosen | 343/909 |
| 4,814,785 | 3/1989 | Wu | 333/202 X |

OTHER PUBLICATIONS

Arnaud, J. A. & Ruscio, J. T.; "Resonant-Grid quasioptical Diplexer" *Electronics Letters;* vol. 9, No. 25; 13 Dec. 1973; pp. 589-590.

*Primary Examiner*—David C. Cain

*Attorney, Agent, or Firm*—William J. Streeter; Wanda K. Denson-Low

[57] ABSTRACT

An improved bandpass frequency selective surface is disclosed which provides a wide pass band and reflection band with low loss at varying angles of incidence, low cost, low volume and light weight. The improved bandpass frequency selective surface of the present invention includes a mesh-patch array 10 disposed on at least a portion of a surface wherein the mesh-patch array 10 includes a square grid 12 surrounding numerous squares 20, 21, 22 and 23. A specific teaching of the invention concerns the design of the elements of a mesh-patch array 10 such that the frequency selective surface transmits or reflects the desired microwave signals.

2 Claims, 1 Drawing Sheet

BANDPASS FREQUENCY SELECTIVE SURFACE

BACKGROUND OF THE INVENTION

1. Field of the Invention

The present invention relates to microwave circuits. More specifically, the present invention relates to surfaces used to selectively pass and reflect microwave signals.

While the present invention is described herein with reference to a particular embodiment for an illustrative application, it is understood that the invention is not limited thereto. Those having ordinary skill in the art and access to the teaching provided herein will recognize additional modifications, applications and embodiments within the scope thereof.

2. Description of the Related Art

Frequency selective surfaces selectively pass microwave signals. A microwave signal applied to a frequency selective surface will be either passed through the surface or reflected off of the surface depending upon the electrical characteristics of the frequency selective surface and the frequency of the applied signal.

Reflector antennas make use of frequency selective surfaces to provide dual or multiple frequency band operation. Frequency selective surfaces generally consist of arrays of elements such as squares, circles, Jerusalem crosses, concentric rings or double squares supported by a dielectric substrate.

Frequency selective surfaces are known to have several limitations. In order to provide low insertion losses and reflection losses, frequency selective surfaces must generally be fabricated with multiple layers. However, the characteristics of multiple layer frequency selective surfaces are typically dependent on the angle of incidence of the microwave signal. Thus, the pass band and reflection band of the frequency selective surface may vary with the incidence angle of the applied microwave signal.

In addition, multiple layer frequency selective surfaces are generally difficult and costly to manufacture. Also, a multiple layer frequency selective surface may be unacceptable for certain uses including spacecraft applications due to increased weight and volume.

There is therefore a recognized need in the art for a frequency selective surface with low insertion and reflection losses, stable pass band and reflection band characteristics at varying angles of incidence, light weight, low cost and low volume suitable for spacecraft systems and other applications requiring a high ratio of pass band and reflection band transmission to weight, volume and cost.

SUMMARY OF THE INVENTION

The deficiencies demonstrated by the related art are substantially addressed by the improved bandpass frequency selective surface of the present invention. The invention provides a frequency selective surface with a wide pass band and reflection band having low losses at varying angles of incidence, low cost, low volume and light weight. The improved bandpass frequency selective surface of the present invention includes a mesh-patch array disposed on at least a portion of a surface wherein the mesh-patch array includes a square grid surrounding numerous squares. A specific teaching of the invention concerns the design of the elements of a mesh-patch array such that the frequency selective surface transmits or reflects the desired microwave signals.

DESCRIPTION OF THE INVENTION

Frequency selective surfaces are used in a variety of antenna applications. Typically, frequency selective surfaces are constructed with arrays of geometric shapes. See for example, U.S. Pat. No. 4,814,785 entitled Wideband Gridded Square Frequency Selective Surface, Ser. No. 07/148,312, filed Jan. 25, 1988, issued Mar. 21, 1989 to Te-Kao Wu et. al. A portion of a mesh-patch array 10 constructed in accordance with the teachings of the present invention is shown in FIG. 1.

Figure 1:
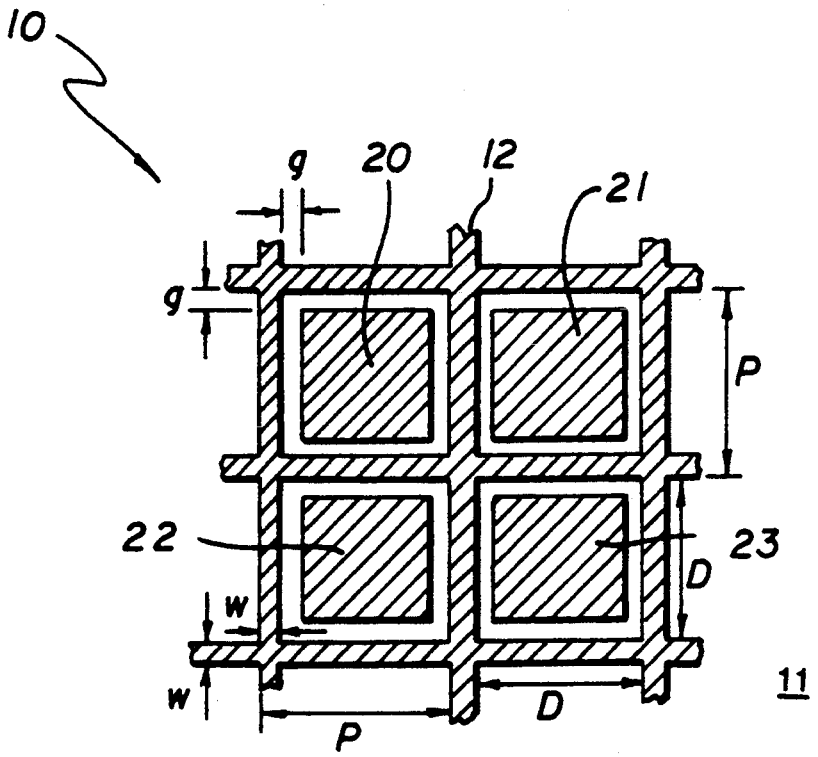
FIG. 1 shows a portion of the mesh-patch array of the improved bandpass frequency selective surface constructed in accordance with the teachings of the present invention.

The elements comprising the mesh-patch array 10 as shown in FIG. 1 in partial view are squares 20, 21, 22 and 23 and a square grid 12 surrounding these squares 20, 21, 22 and 23. The mesh-patch array 10 of the present invention is generally disposed on at least a portion of a surface 11. Typically the surface 11 upon which the mesh-patch array 10 is disposed is a dielectric substrate and the array elements are generally etched onto this dielectric substrate. The dielectric substrate may be Kapton or any other suitable material and the array elements may be copper or any other suitable material. It will be appreciated by those skilled in the art that the type of surface upon which the mesh-patch array 10 is disposed and the composition of the elements of the mesh-patch array 10 may vary without departing from the scope of the present invention.

Figure 2:
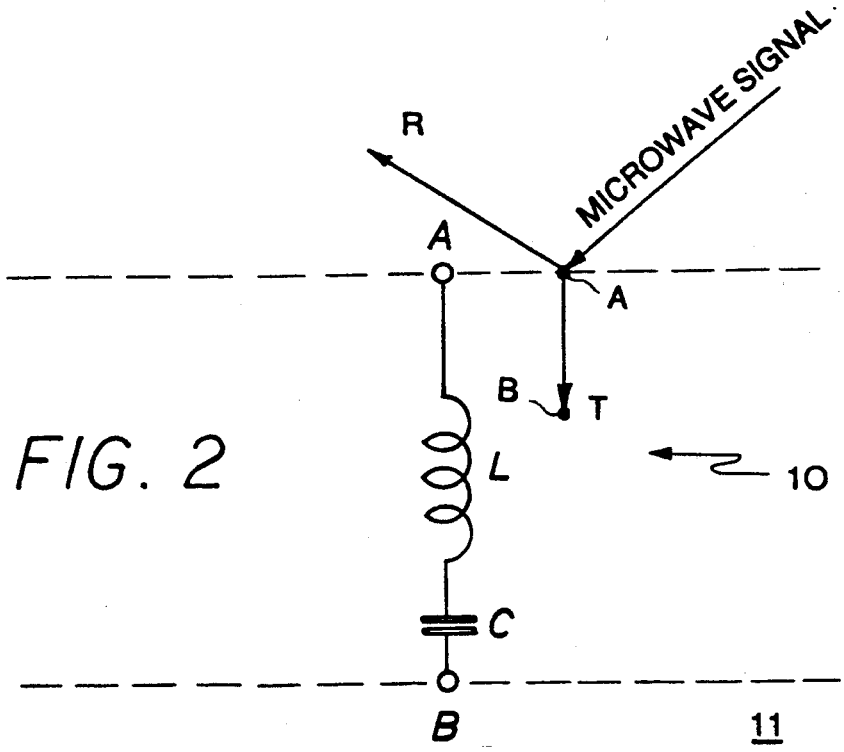
FIG. 2 is a schematic illustration of the equivalent circuit model of the mesh-patch array of the present invention.

FIG. 2 provides a schematic illustration of the equivalent circuit model of the mesh-patch array 10. As shown in FIG. 2, the equivalent circuit model of the mesh-patch array 10 is an inductor, L, in series with a capacitor, C. The values of the components of the equivalent circuit model shown in FIG. 2 relate to the dimensions of the elements of the mesh-patch array 10.

The dimensions of the elements of the mesh-patch array 10 can be designed to provide a low loss frequency selective surface with the desired characteristics. As shown in FIG. 1, the width of the lines of the square grid 12 is W. The distance between the lines of the square grid 12 and the squares 20, 21, 22 and 23 is g. The distance between the lines of the square grid 12 is D and the distance from the beginning of one line of the square grid 12 to the beginning of the adjacent line of the square grid 12 is P.

The reflection and transmission characteristics of a microwave signal applied to a frequency selective surface comprised of the mesh-patch array 10 will be essentially the same as the reflection and transmission characteristics of a microwave signal applied to point A of the equivalent circuit model shown in FIG. 2, where the reflected signal, R, is reflected from point A and the transmitted signal, T, is that received at point B of the equivalent circuit model. The equations for the reflected signal, R, and the transmitted signal, T, are:

$$R=1/(1+Y^2), \text{ and } T=1-R.$$

Where:

$Y=1/(2(X-1/B))$, $X=\omega L$, and $B=\omega C$, where $\omega=2\pi f$, where f is the frequency of the applied microwave signal.

The variables X and B are related to the dimensions of the elements of the mesh-patch array 10 as follows:

$X=D/P(P/\lambda(\ln(\csc(\pi g/P))))$, and $B=4D/P(P/\lambda(\ln(\csc(\pi W/2P))))$, where $\lambda$ is the wavelength of the applied microwave signal.

Thus, for a desired pass band of 12.25 to 14.5 GHz, and a desired reflection band of 1.5 to 1.6 GHz, the dimensions of the mesh-patch array are P equal to 0.24 inches, g equal to 0.022 inches, D equal to 0.228 inches and W equal to 0.012 inches. While the dimensions of the elements of the mesh-patch array 10 largely determine the transmission and reflection characteristics of the frequency selective surface, those skilled in the art will appreciate that the thickness of the surface upon which the mesh-patch array 10 is disposed may partially determine the frequency selective surface characteristics. Typically, the thicker the surface, the lower the transmission and reflection bands.

Those skilled in the art with access to the teachings of the present invention will recognize that the dimensions of the elements of the mesh-patch array 10 may be modified to provide an improved bandpass frequency selective surface with the desired characteristics without departing from the scope of the present invention. In addition, those skilled in the art will appreciate that the thickness of the surface upon which the mesh-patch array is disposed may vary.

The improved bandpass frequency selective surface of the present invention can be used for linear, dual linear or circular polarizations. The present invention offers an advantage over other types of frequency selective surfaces in the application of bandpass radome designs.

While the present invention has been described herein with reference to an illustrative embodiment and a particular application, it is understood that the invention is not limited thereto. Those having ordinary skill in the art and access to the teachings of the present invention will recognize additional modifications and applications within the scope thereof. For example, since most of the surface area of the mesh-patch array is metal, the mesh-patch array may also be used in spacecraft and other applications to reflect light and reduce heat penetration.

It is therefore intended by the appended claims to cover any and all such modifications, applications and embodiments.

Accordingly,

What is claimed is:

1. An improved frequency selective surface comprising:

a square grid composed of a first plurality of lines of material having a first conductivity perpendicularly intersecting a second plurality of lines of material having said first conductivity so as to provide a plurality of square spaces therebetween, each of said plurality of lines having a spacing D, the distance from the beginning of a line of said first plurality of lines to the beginning of an adjacent line of said first plurality of lines and the distance from the beginning of a line of said second plurality of lines to the beginning of an adjacent line of said second plurality of lines being equal to P and the width of said lines of said first plurality of lines and the width of said lines of said second plurality of lines being equal to W;

a plurality of squares of material having said first conductivity wherein each square of said plurality of squares is disposed within an associated square space of said plurality of square spaces and the distance between each edge of each square of said plurality of squares and the adjacent line of said first plurality of lines or the adjacent line of said second plurality of lines is g; such that P is equal to 0.24 inches, g is equal to 0.022 inches, D is equal to 0.228 inches and W is equal to 0.012 inches and a surface of material having a second conductivity, said square grid and said plurality of squares being disposed on at least a portion of said surface.

2. A mesh-patch array comprising:

a square grid composed of a first plurality of lines of material having a first conductivity perpendicularly intersecting a second plurality of lines of material having said first conductivity so as to provide a plurality of square spaces therebetween, each of said plurality of lines having a spacing D, the distance from the beginning of a line of said first plurality of lines to the beginning of an adjacent line of said first plurality of lines and the distance from the beginning of a line of said second plurality of lines to the beginning of an adjacent line of said second plurality of lines being equal to P and the width of said lines of said first plurality of lines and the width of said lines of said second plurality of lines being equal to W;

a plurality of squares of material having said first conductivity wherein each square of said plurality of squares is disposed within an associated square space of said plurality of square spaces and the distance between each edge of each square of said plurality of squares and the adjacent line of said first plurality of lines or the adjacent line of said second plurality lines is g, the dimensions for the elements of the mesh-patch array being related as follows $R=1/(1+Y^2)$ and $T=1-R$, where T represents the equation of said microwave signal of said first frequency that will pass through said surface and R represents the equation of said microwave signal of said second frequency that will be reflected from said surface, $Y=1/(2(X-1/B))$, $X=\omega L$, $B=\omega C$, $\omega=2\pi f$, f is the frequency of the applied microwave signal, L is the equivalent inductance of the array, C is the equivalent capacitance of the array, $X=D/P(P/\lambda(\ln(\csc(\pi g/P))))$, $B=4D/P(P/\lambda(\ln(\csc(\pi W/2P))))$, and $\lambda$ is the wavelength of the applied microwave signal.

* * * * *